United States Patent [19]

Björkman et al.

[11] Patent Number: 4,476,606

[45] Date of Patent: Oct. 16, 1984

[54] WALL-MOUNTED FOLDABLE AIRING OR CARPET-BEATING STAND

[75] Inventors: Lars Björkman; Börje Bång, both of Växjö, Sweden

[73] Assignee: Promovo AB, Växjö, Sweden

[21] Appl. No.: 508,022

[22] Filed: Jun. 27, 1983

[30] Foreign Application Priority Data

Oct. 26, 1982 [SE] Sweden ..... 8206068

[51] Int. Cl.[3] ..... A47L 13/54

[52] U.S. Cl. ..... 15/268; 108/48; 211/100; 211/105.1

[58] Field of Search ..... 15/268, 141 R, 141 A, 15/91; 248/240.2; 211/99, 100, 104, 105.1; 108/48

[56] References Cited

U.S. PATENT DOCUMENTS

| | | | |
|---|---|---|---|
| 1,315,656 | 9/1919 | Burgener | 15/268 |
| 1,541,342 | 6/1925 | Friel | 108/48 |
| 1,595,628 | 8/1926 | Small | 108/48 |

FOREIGN PATENT DOCUMENTS

| | | | |
|---|---|---|---|
| 2466217 | 4/1981 | France | 108/48 |
| 112466 | 11/1944 | Sweden . | |
| 162215 | 2/1954 | Sweden . | |
| 523056 | 7/1940 | United Kingdom . | |

*Primary Examiner*—Edward L. Roberts

*Attorney, Agent, or Firm*—Harness, Dickey & Pierce

[57] ABSTRACT

A wall-mounted foldable airing or carpet-beating stand comprising an attachment bracket secured to the wall to support the inner end of a bar which in position of use of the stand assumes a horizontal position, and two support legs pivotally mounted in pivot points at the outer end of the bar. The bar is mounted for pivotal movement about a horizontal shaft in the attachment bracket. The shaft is displaceable in the vertical direction along slits or channels formed in the attachment bracket from or towards a lower operational position of the bar and an upper position of rest. In this position the bar may be pivoted to a vertical position.

3 Claims, 4 Drawing Figures

WALL-MOUNTED FOLDABLE AIRING OR CARPET-BEATING STAND

BACKGROUND OF THE INVENTION

The subject invention concerns a wall-mounted foldable airing and carpet-beating stand comprising an attachment bracket which is secured to the wall to support the inner end of a bar which in position of use of the stand assumes a horizontal position, and two support legs which are pivtoally mounted in pivot points at the outer end of the bar.

Carpet-beating stands of the kind referred to must be simple and safe to use. Ideally, they should be manufactured from corrosion-resistant materials, be able to withstand the effects of various kinds of climatic changes and should be cheap to manufacture. In addition, the stand should be designed to ensure that in position of use no sharp edges or protruding details could cause damage or injury to the person using the stand.

SUMMARY OF THE INVENTION

The purpose of the subject invention is to provide a foldable carpet-beating stand meeting the requirements outlined above.

For this purpose the carpet-beating stand in accordance with the subject invention is characterised in that the bar is mounted for pivotal movement about a horizontal shaft, said shaft mounted in the attachment bracket and arranged to be displaceable in the vertical direction along slits or channels formed in the attachment bracket between the lower bar position which corresponds to the operational position of the stand and the upper bar position in which position the bar may be pivoted to a vertical position.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 4:
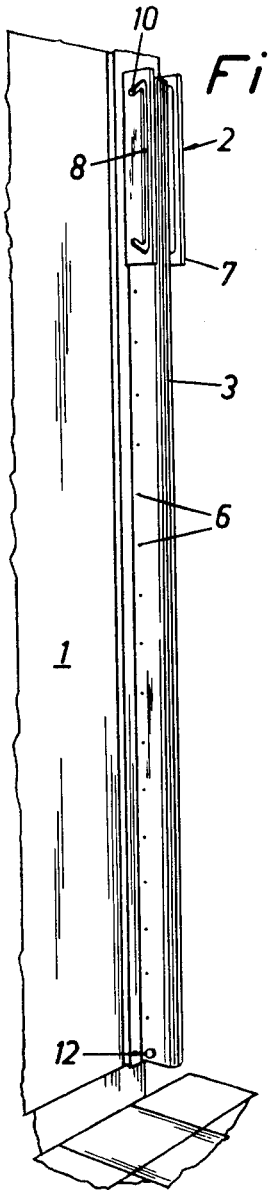
FIG. 4 illustrates the stand in the folded position thereof.
Figure 1:
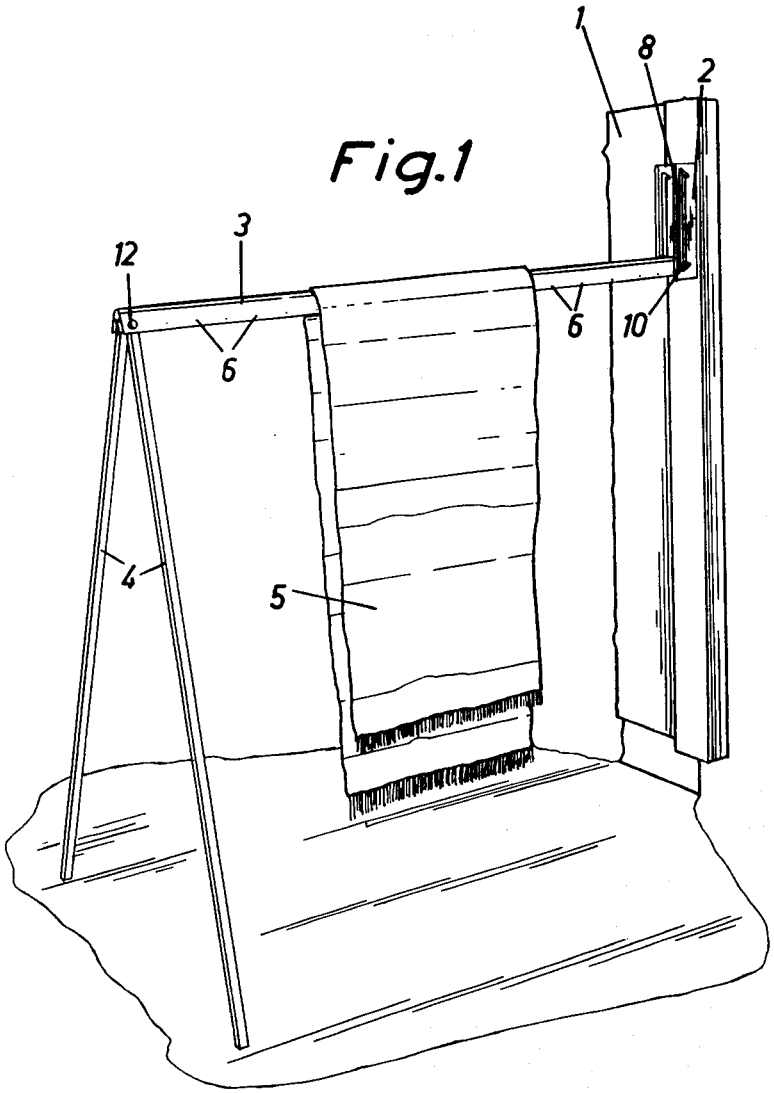
FIG. 1 shows an airing and carpet-beating stand in accordance with the invention in the operational position thereof.
Figure 3:
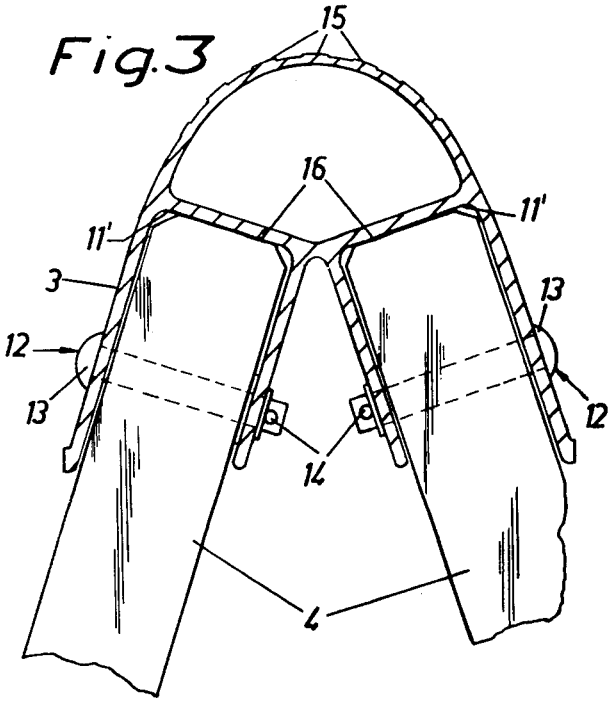
FIG. 3 is a cross-sectional view through the bar incorporated in the stand in accordance with the invention.
Figure 2:
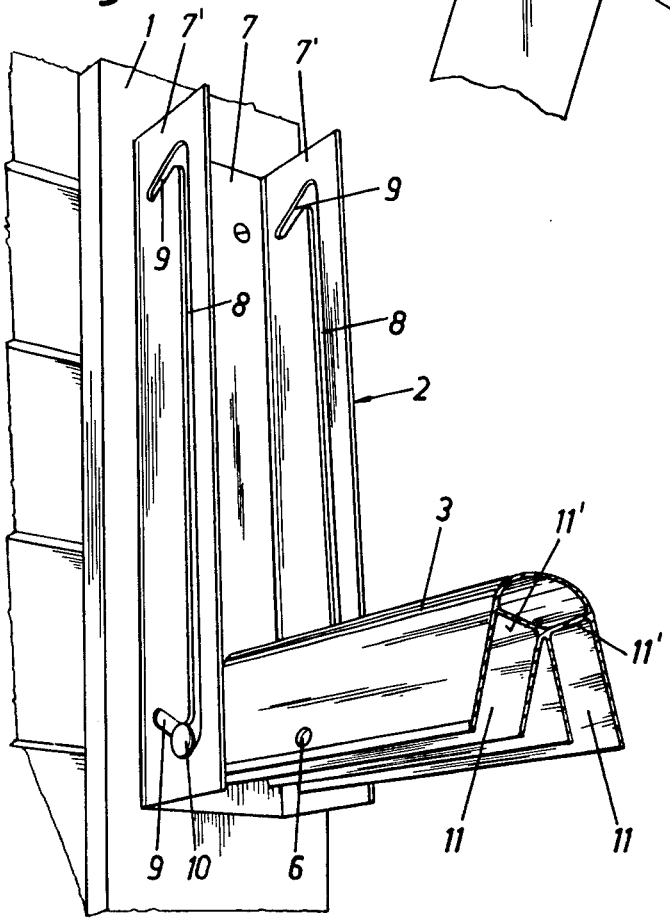
FIG. 2 shows on an enlarged scale the wall-mounted attachment bracket forming part of the carpet-beating stand.

The carpet-beating stand is mounted on a wall 1 adjacent an out-door terrace or the like and comprises an attachment bracket 2 designed to support a bar 3. At the free end of the bar are mounted two support legs 4. The bar 3 forms a horizontal surface supporting a carpet 5 or similar object. In addition, the bar 3 is provided with a number of apertures 6 from which clothes-hangers or the like may be suspended.

THe attachment bracket 2 consists of a sheet-metal member 7 which is bent to U-shape and screwed onto the wall 1. The legs 7' of the sheet-metal member are provided with one vertical slit 8 each. The slits 8 comprise short upwardly and downwardly directed portions 9 from respectively the uppermost and lowermost points of the slits 8.

The bar 3 is mounted in the slits 8 so as to be allowed slidable and pivotal movements therein with the aid of a pin 10 passing through the attachment bracket 2 and the bar 3. The lower position of the bar 3 in the slits 8 corresponds to the operational position of the carpet-beating stand with the support legs 4 in the folded-down position. In the upper position in the slits 8 the bar 3 may be swung downwards, flat against the wall 1, the support legs 4 first having been folded in underneath the bar to be accomodated in the bar interior. In order to make it possible to pivot the support legs 4 into a position inside the bar 3, the latter is provided with two lengthwise channels 11 which open downwards and diverge somewhat outwards. A pivot point 12 is provided in each support leg 4 in the associated channel 11 at the free end of the bar. The pivot axis of each support leg 4 in the associated pivot point 12 extends at right angles to the longitudinal axis of the respective support leg. The pivot points 12 are formed by pins 13 passing through the bar 3 and the support legs 4 and secured at the inner face of the bar, for instance with the aid of a cotter pin 14.

The bar 3 and the support legs 4 are preferably manufactured from extruded aluminium which combines low weight with high strength and durability. Anodizing provides satisfactory protection of the material against corrosion.

The upper face of the bar 3 is provided with lengthwise grooves 15 increasing the friction against a carpet 5 slung over the bar and preventing the carpet from sliding off the latter.

When the carpet-beating stand is to be folded from the operational position to the position illustrated in FIG. 4 the free end of the bar 3 is first lifted somewhat to raise the support legs 4 off the ground. The support legs 4 are then swung upwards and positioned inside the channels 11 while at the same time the bar 3 is pivoted downwards and its inner end displaced upwards inside the attachment bracket 2 until the pin 10 may be inserted into the downwardly directed portions 9 of the slits 8. The carpet-beating stand now is suspended in the position shown in FIG. 4. Folding outwards or extension of the carpet-beating stand is effected in the same way but in the inverse order. When the bar assumes its lower, extended position in the attachment bracket 2, a lateral force will be exerted on the support legs 4 in the direction towards the wall 1, which force will be transferred through the bar 3 into the bracket 2, allowing the pin 10 to be displaced in an inwards upwards direction along the portions 9 of the slits which are directed obliquely upwards. A vertical edge of the inner end of the bar will then abut against and be supported by the bracket 2, which prevents the bar from being inadvertently folded downwards, should anyone by carelessness or accident pivot the support legs 4. At the same time the inner end of the bar 3 is prevented from moving upwards as a result of any pressures or impacts that it may be exposed to from underneath. In order to prevent the support legs 4 from being pivoted outwards past their essentially vertical position of support, the inner ends of the support legs are provided with support faces 16 which in said support position abut against the bottom 11' of the channels 11.

The invention is not limited to the embodiment described in the aforegoing but a number of modifications are possible within the scope of the appended claims. For instance, the support bracket 2 may be produced in an extrusion process to produce a profile member incorporating channels in which are provided blocking means at the channel bottom and means from which the pin 10 may be suspended at the channel apices. Furthermore, the bar 3 may be given a different configuration and other means may be used to achieve the desired movability at the pivot pints.

What we claim is:

1. An improved wall-mounted foldable airing and carpet-beating stand comprising a bar arranged in position of use of said stand to assume a horizontal position, pivot points at the outer end of said bar, an attachment bracket secured to said wall to support the inner end of said bar, and two support legs pivotally mounted in said pivot points at the outer end of said bar, the improvement comprising a horizontal shaft mounted in said attachment bracket, said bar mounted for pivotal movement about said horizontal shaft, slits or channel means formed in said attachment bracket, said horizontal shaft arranged for displacement in the vertical direction along said slits or channel means between a lower bar position corresponding to the operational position of said stand, and an upper bar position, in which position said bar may be pivoted to a vertical, non-operational position of said stand.

2. An improved stand as claimed in claim 1, wherein said support legs are pivotable in their respective oblique plane on either side of a vertical plane passing through the longitudinal axis of said bar, said oblique planes intersecting in or near the longitudinal axis of said bar.

3. An improved stand as claimed in claim 1, comprising short, obliquely downwards directed portions in said slits or channel means formed in said attachment bracket, said oblique portions extending from the highest point of said slits or channel means.

* * * * *